US006389652B1

(12) United States Patent
Williams

(10) Patent No.: US 6,389,652 B1
(45) Date of Patent: May 21, 2002

(54) CLOSURE CLIP

(76) Inventor: Robert J. Williams, 901 Moore St., No. 28, Baraboo, WI (US) 53913

( * ) Notice: Subject to any disclaimer, the term of this patent is extended or adjusted under 35 U.S.C. 154(b) by 0 days.

(21) Appl. No.: 09/906,420

(22) Filed: Jul. 16, 2001

Related U.S. Application Data

(63) Continuation-in-part of application No. 09/749,219, filed on Dec. 27, 2000.

(51) Int. Cl.[7] ..... A44B 21/00; B65D 77/10

(52) U.S. Cl. ..... 24/30.5 R; 24/30.5 P; 24/30.5 S; 24/130; 24/129 B

(58) Field of Search ..... 24/303, 30.5 R, 24/30.5 S, 30.5 P, 130, 129 B, 127, 570, 563, DIG. 29, DIG. 28, DIG. 9

(56) References Cited

U.S. PATENT DOCUMENTS

| | | | | | |
|---|---|---|---|---|---|
| 402,786 | A | * | 5/1889 | Tyler | 24/130 |
| 904,747 | A | * | 11/1908 | Anderson | 24/130 |
| 1,426,537 | A | * | 8/1922 | Bauer | 24/130 |
| 2,048,300 | A | * | 7/1936 | Showers | 24/130 X |
| 2,536,159 | A | * | 1/1951 | Darkins | 24/130 |
| 3,170,213 | A | | 2/1965 | Thomas, Jr. | |
| 3,257,695 | A | | 6/1966 | Frame | |
| 3,264,698 | A | | 8/1966 | Wright | |
| 3,267,540 | A | * | 8/1966 | Wolcott et al. | 24/130 |
| 3,270,874 | A | | 9/1966 | Hilton | |
| 3,348,595 | A | | 10/1967 | Stevens, Jr. | |
| 3,357,070 | A | | 12/1967 | Sloan | |
| 3,417,912 | A | | 12/1968 | Paxton | |
| 3,675,276 | A | * | 7/1972 | Nuse | 24/129 B X |
| 3,925,852 | A | | 12/1975 | Wood | |
| 4,356,600 | A | | 11/1982 | Welch | |
| 4,414,717 | A | | 11/1983 | Payne | |
| 4,835,820 | A | | 6/1989 | Robbins, III | |
| 4,871,264 | A | | 10/1989 | Robbins, III et al. | |
| 4,947,523 | A | | 8/1990 | Robbins, III et al. | |
| 5,218,742 | A | | 6/1993 | Sleven | |
| 5,379,489 | A | | 1/1995 | Delk et al. | |
| 5,473,796 | A | | 12/1995 | Fusillo | |
| 5,802,677 | A | | 9/1998 | Dorman et al. | |
| 5,921,601 | A | | 7/1999 | Buckles | |

* cited by examiner

*Primary Examiner*—Robert J. Sandy
(74) *Attorney, Agent, or Firm*—Charles L. Leeck; Godfrey & Kahn, S.C.

(57) ABSTRACT

A closure clip for fastening closed a bag or similar article having a unitary, generally flat, slotted body having at least two elongated juxtaposed space-apart members. The members define at least one slot extending longitudinally between the members and the members are further shaped so that the slot has a wide, bag-gathering area located in an open end of the slot. The slot transitions from the bag-gathering area to a narrow bag-accepting area located at a closed end of the slot. The invention also includes at least one aperture located in the body spaced-apart from the members and the slot and sized to accommodate a human's finger or thumb. A closure clip is fastened and removed from the open end of a bag using arm strength and is not reliant on finger strength or dexterity making the clip particularly user friendly.

12 Claims, 3 Drawing Sheets

CLOSURE CLIP

RELATED CASE

The present application is a continuation-in-part of co-pending U.S. patent application Ser. No. 09/749,219 filed Dec. 27, 2000.

BACKGROUND OF THE INVENTION

The present invention relates to devices used to close flexible bags. In particular, the present invention is directed to a closure clip designed to utilize arm strength instead of finger/hand strength to secure the closure clip to the bag thereby effectively closing the bag.

Edible and non-edible items are commonly supplied to consumers in flexible paper or plastic bags. These bags are typically sealed subsequent to filling by heat sealing or mechanical fasteners. Unfortunately, bags fastened by these approaches can only be opened by tearing a portion or the bag, thereby damaging the bag and rendering the bag nearly impossible to reseal. For multiple inedible items packaged in bags, resealing the bag after initial opening avoids unwanted loss of multiple unused items. For edible items, resealing the bag minimizes air contact and allows the food items to be stored for longer periods of time. For example, edible items such as potato chips may go stale if left open to the air but may be kept fresh for long periods of time if even partially sealed. In this regard, several types of devices have been invented to provide sealing of bags.

The two predominant closures currently utilized to reseal flexible bags are simple paper-covered wires and small one-piece flexible plastic clips. However, these closures often are subject to breakage due to inherent design weaknesses. In addition, these closures are small in size and are easy to lose in the midst of a busy kitchen counter top or workbench space. Furthermore, these closures require complex hand manipulation, finger dexterity and finger strength.

Several of the clip-type closures require the user to twist the neck of the bag prior to attachment of the closure to the bag. Examples of such closures include U.S. Pat. Nos. 5,473,796, 3,925,852 and 4,835,820. Although simple in design, the twist step required by these closures is difficult for people with arthritis or other infirmities who lack the necessary finger strength to accomplish the twisting motion.

More complex multi-piece closure clips are also currently available. Many of these clips are expensive to manufacture as they require complex molding equipment in addition to complicated assembly procedures. This high cost of manufacture is passed on to consumers in higher retail prices. These multi-piece clips also typically require the user to possess an appreciable amount of hand strength. The multi-piece designs also have reduced useful lifetimes due to breakage of subunits and/or subunit connections.

Various closure clip designs have been previously disclosed. U.S. Pat. No. 4,414,717 is a three-prong one-piece closure device which requires a complex molding process during its manufacturing process. The closure is designed to close snack bags and utilizes separate lengths of prongs to close various size bags. U.S. Pat. No. 5,921,601 is a complex multi-piece closure device including three arms and a securing ring. U.S. Pat. No. 4,871,264 is a bar-type closure device having two arms, a hinge and locking member. U.S. Pat. No. 5,397,489 is a multi-piece design having a bar-type closure. U.S. Pat. No. 4,947,523 is a multi-piece closure having a finger hole, a handle member and a clasp. The above-listed patents all disclose devices which require the user to possess hand strength and be capable of complex finger manipulation.

Several multi-piece devices include spring loaded assembles including U.S. Pat. Nos. 5,802,677, 4,356,600 and 4,803,799. These devices have spring-loaded jaws or clamps and require considerable dexterity and finger strength to use in closing bags. In addition to the functional complexity of these devices, the price to the consumer is also higher as manufacturing processes are more expensive due to mechanical complexity.

Hence, there is a need for a closure clip that is generally easy to use and mechanically durable. The closure clip will ideally be of low cost to manufacture and consequently of low price to the consumer. Importantly, the closure clip will utilize arm strength instead of finger and hand strength and dexterity so that the closure clip is friendly to use for all individuals.

SUMMARY OF THE INVENTION

In accordance with the above-stated objectives, the present invention is a closure clip for fastening closed a bag or similar article. The closure clip has a unitary, generally flat, slotted body having at least two elongated juxtaposed spaced-apart members. These members define at least one slot extending longitudinally between the members, with the members being further shaped so that the slot has a wide, bag-gathering area located at an open end of the slot. The slot transitions from this wide, bag-gathering area continually to a narrow bag-accepting area at a closed end of the lot. The closure clip further includes at least one aperture located in the body. This aperture is spaced-apart from the members and the slot and sized to accommodate a human's finger or thumb. The two members may lie in substantially the same plane.

A closure clip according to the invention may be constructed of metal and be magnetized to allow the closure clip to be stored on a flat, vertical metal surface, such as a refrigerator door.

Alternatively, the closure clip may be constructed of plastic. The plastic construction is ideally semi-ridged in design with high-density polyethylene being a suitable material.

The aperture located in the body of the closure clip may be circular in shape to better accommodate a human's finger or thumb. A surface of the body facing the aperture may also be textured to provide improved grip to a human finger or thumb inserted through the aperture.

In one embodiment of the invention, the elongated juxtaposed spaced-apart members are two in number thereby defining a single slot. The aperture may be generally located on an opposite end of the body from the wide, bag-gathering area of the slot. Alternatively, the aperture may be spaced apart from and located on an opposite end of the body from the narrow, bag-accepting area. A second aperture may be located on the body and is spaced apart from and generally located closer to the wide bag-gathering area of the slot then the first aperture.

Another embodiment of the invention may include three members thereby defining two slots. The slots are separated and spaced apart from each other, each slot having a narrow bag-accepting area and a wide, bag-gathering area. In this embodiment, the aperture is spaced apart and generally located on an opposite end of the body from the wide, bag-gathering area of the slot. The narrow, bag-accepting areas of each of the slots can be of different widths in this embodiment to accommodate closing bags having differing thicknesses. In addition, the longitudinal lengths of the slots do not necessarily have to be equal.

A clip according to the present invention may also have a body which includes a sufficient flat area to accept printing, advertising, decorating and labeling as applied by the manufacturer of the clip, an intermediate distributor, or the user.

In addition, the body of the closure clip may include at least one tool integrally molded along a peripheral edge of the body. Such a tool may be simple in nature and include a notch for opening bottles, a screwdriver head for turning screws, or a hook to open tabbed cans.

Other features and advantages of this invention will become more clear to the reader after careful consideration is given to the following detailed description of the preferred exemplary embodiments thereof.

Various other features, objects, and advantages of the invention will be made apparent to those skilled in the art from the accompanying drawings and detailed description thereof

BRIEF DESCRIPTION OF THE DRAWINGS

Reference will hereinafter be made to the accompanying drawings wherein like reference numerals throughout the various figures denote like structural elements, and wherein.

DETAILED DESCRIPTION OF THE INVENTION

Figure 1:
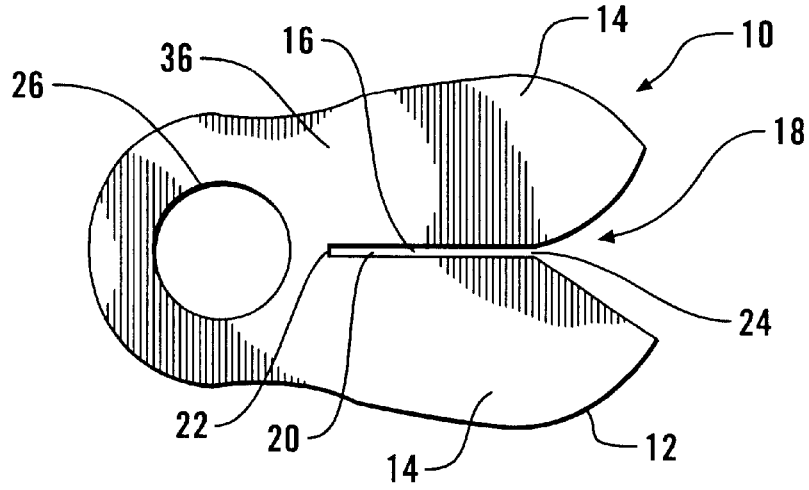
FIG. 1 is a top plan view of a first embodiment of a closure clip according to the invention having two members, a single slot and a single aperture.

Referring now to FIG. 1, a closure clip 10 for fastening closed a bag or similar article is generally formed by a unitary, generally-flat slotted body 12. Body 12 includes at least two elongated, juxtaposed, space-apart members 14. Members 14 define at least one slot 16 extending longitudially between members 14. As shown in FIG. 1 and throughout the remaining figures, members 14 are shaped so that slot or slots 16 have a wide, bag-gathering area 18 located at an open end 24. Slot 16 transitions from open end 24 to a closed end 22 where a narrow, bag-accepting area 20 is located. Body 12 further includes at least one aperture 26 located in body 12 and spaced-apart from the member 14 and the slot 16. Aperture 26 is sized to accommodate a human finger or thumb. The diameter of the aperture 26 to accommodate a human finger or thumb may be between 0.5 to 1.5 inches.

A clip 10 according to the present invention is preferably formed from a semi-rigid material amendable to molded or press punch manufacturing, as is commonly known in the art. Clip 10 may be constructed from a metal. The metal may be, for example aluminum, copper, tin, iron, brass or various alloy combinations thereof This list is not exclusive and other metals commonly known in the art may be utilized. The metal may be magnetized thereby allowing the closure clip to be stored on a flat, vertical metal surface, such as a refrigerator door.

In another embodiment of the invention, the closure clip may be formed from a plastic having semi-ridged characteristics. A plastic suitable for this purpose may be polyurethane, polypropylene or polyethylene with high-density polyethylene being preferred.

Figure 6:
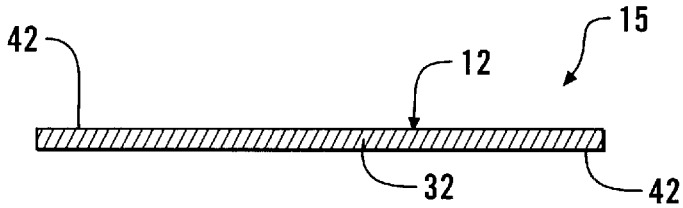
FIG. 6 is a side elevational view of the closure clip shown in FIG. 4 further illustrating the respective thickness of the closure clip.

As shown throughout the figures, a closure clip according to the invention includes an aperture 26 which is circular in shape to better accommodate a human's finger or thumb. Members 14 of closure clip 10 are preferably configured to lie in substantially the same plane. This configuration provides a side profile as illustrated in FIG. 6.

Figure 3:
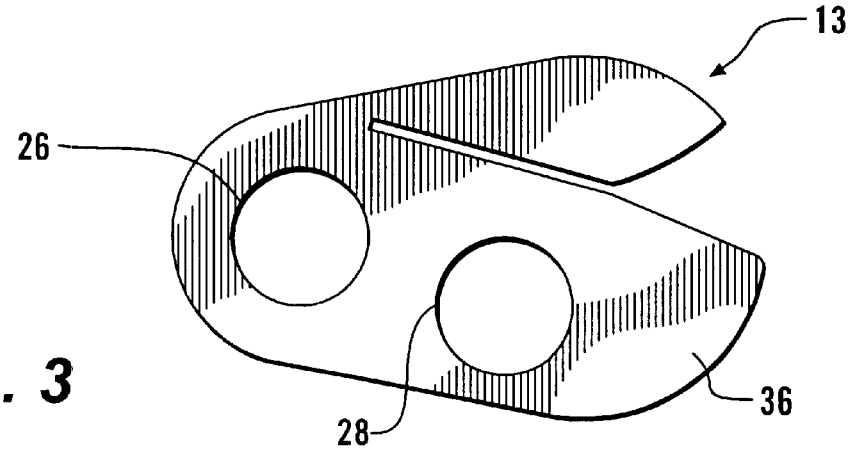
FIG. 3 is a top plan view of a third embodiment of a closure clip having two members, a single slot and two apertures.

Closure clip 10 illustrated in FIG. 1 includes two members 14 which define a single slot 16. The embodiment illustrated in FIG. 1 shows the aperture 26 spaced apart and generally located on an opposite end of the body 12 from the wide, bag-gathering area 18 of slot 16. FIG. 3 illustrates an alternative embodiment 13 in which a second aperture 28 is located on body 12 and is spaced apart from and located closer to the wide, bag-gathering area 18 of slot 16 then the first aperture 26. As can be appreciated by comparison of FIG. 1 and FIG. 3, FIG. 3 allows a user to insert at least two fingers thereby providing additional leverage for manipulating and forcing the clip.

Figure 2:
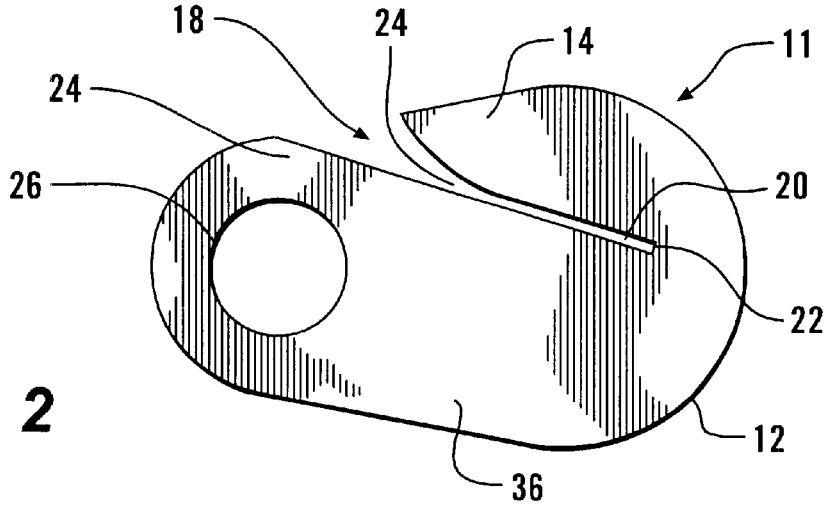
FIG. 2 is a top plan view of a second embodiment of a closure clip according to the invention having two members, a single slot and single aperture.

FIG. 2 illustrates an embodiment 11 of the present invention where aperture 26 is spaced apart from and generally located on an opposite side of body 12 from the narrow bag-accepting area 20. The embodiment of FIG. 2 allows a user, if the user so desires, to use a pulling, downward motion to slide the open end of a bag through the bag-gathering area 18 to secure the bag within the narrow, bag-accepting area 20. This is in contrast to the embodiment 10 shown in FIG. 1 where the reverse motion is most convenient for the user to accomplish closure of a bag. However, it is emphasized that all embodiments of the invention disclosed herein in that they utilize arm strength to close and subsequently open a bag as opposed to hand or finger strength.

Figure 4:
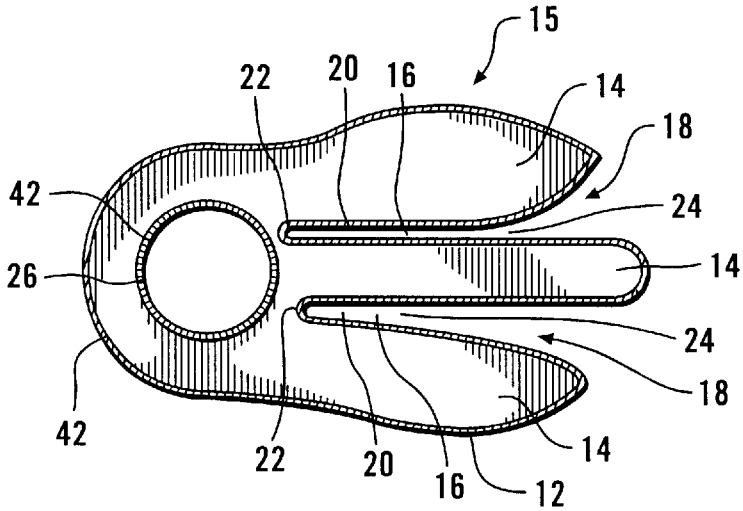
FIG. 4 is a top plan view of a fourth embodiment of the invention having three members, two slots and a single aperture.

FIG. 4 illustrates a closure clip 15 according to the present invention having three members 14. This clip represents the preferred embodiment of the invention. The three members 14 define two slots 16, the slots being separate and spaced apart from each other. Each of the slots 16 have narrow, bag-accepting areas 20 and wide, bag-gathering areas 18. FIG. 4 further shows that aperture 26 is located on an opposite end of the body 12 from the wide bag-gathering area 18 of slot 16. In the preferred embodiment, the slots 16 are of different widths as illustrated in FIG. 4 so that closure of bags with differing thicknesses may be accommodated through the use of a single closure clip. FIG. 4 also illustrates that the longitudinal lengths of the slots 16 do not necessarily have to be equal. Selection of slot widths and longitudinal lengths during manufacture is based on the various dimensions of bag thicknesses the user is expected to encounter.

Figure 5:
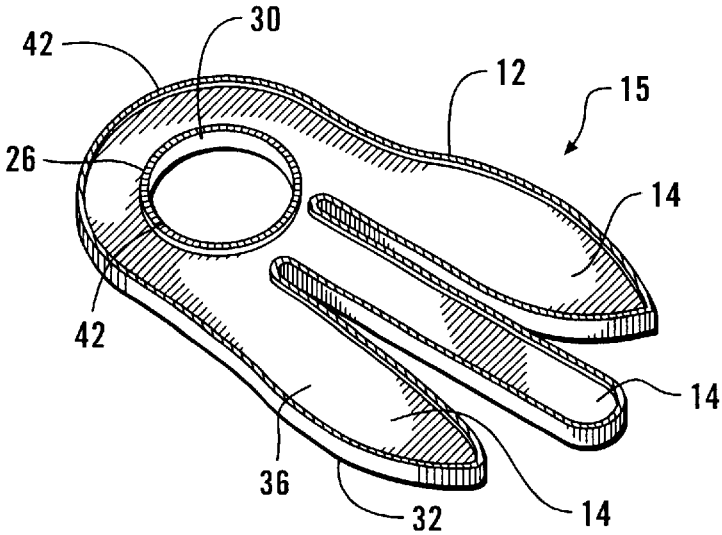
FIG. 5 is a perspective view of the closure clip shown in FIG. 4 illustrating the respective thickness of the closure clip.

FIG. 5 provides a perspective view of the preferred closure clip 15 shown in FIG. 4 and, along with FIG. 6, emphasizes the thickness of body 12 in relation to the overall dimensions of the closure clip. A peripheral edge 32 surrounds an outer side of the body 12. Body 12, as shown in FIGS. 1 through 5, further includes sufficient flat area 36 to accept printing, advertising, decorating and labeling. FIG. 5 also shows a surface 30 facing aperture 26. This surface 30 may be textured as shown in FIG. 5 to provide improved grip to a human finger or thumb inserted through the aperture 26.

FIGS. 4–6 also show a closure clip having a peripheral edge 32 which surrounds body 12 having a raised, reinforcing ridge 42 associated with the edge 32. Reinforcing ridge 42 may also be present at an edge of aperture 26. Ridge 42 is formed by a thickening of the material selected for body 12 and formed by methods known in the art for providing a thickened edge in molded or punch pressed items. Ridge 42 provides added strength to the semi-rigid body 12 and advantageously acts to resist overall clip breakage. The addition of Ridge 42 also makes a clip more suited to receiving longitudinal forces as called for in the use of the invention. The ridge provides these benefits while requiring the addition of only a small amount of material in relation to the body 12, taken as a whole. Although, ridge 42 is shown only in FIGS. 4–6, it is clearly within the invention to include ridge 42 with all embodiments discussed herein.

Figure 7:
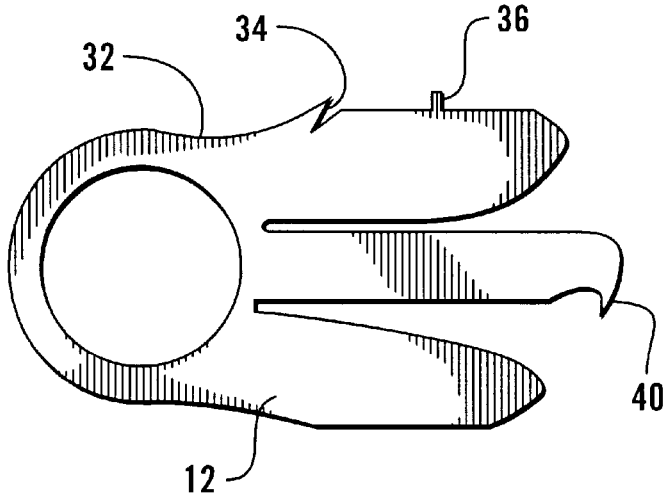
FIG. 7 is a top plan view of a closure clip according to the invention with various tools located along a periphery.

As shown in FIG. 7, a closure clip according to the present invention may be further modified to include a tool integrally molded or formed along a peripheral edge 32 of body 12. This tool may be a notch 34 for opening bottles, a screwdriver head 36 for turning screws, or a hook 40 to open tabbed cans. Additional tools may certainly be included as long as they may be integrally molded or press stamped along peripheral edge 32.

The use of a closure clip according to the invention will now be described in detail. To apply the closure clip, the user first grasps the bag either above or below where the user wishes to insert the closure clip. The open end of the bag may be twisted if desired but twisting is not necessary to practice the invention. The user initially grasps the closure clip in the palm of one hand with a finger(s) and/or thumb inserted through the aperture(s), depending upon the embodiment. Insertion of the index finger is particularly advantageous for the preferred embodiment shown in FIGS. 4–5. The hand may be closed on the body 12 of the clip to provide a simple but yet firm and controlling hold on the clip. The user need not have great finger strength nor dexterity to manipulate the clip according to the invention. The user then guides the bag into the wide, bag-gathering area 18 at the open end 24 of slot 16. When using a closure clip having at least two slots 16, the user may select the slot based on the relative thickness of the bag material to the narrow, bag-accepting area of the particular slot. Holding the bag fixedly, the user may then apply arm strength to force the clip onto the bag area selected for closure. The bag is effectively closed by moving the selected area toward the closed end of the slot into the narrow, bag-accepting area. The closed bag may then be subsequently stored without the worry of spillage of items contained within.

In the case where the user twists a bag neck prior to attaching the clip, the neck is twisted to a sufficient thickness by the user to lodge snugly within the narrow, bag-accepting area of the clip. Alternatively, no twisting is required and the bag neck is simply gathered before attachment of the clip. A further alternative for bag closure is achieved by rolling or folding the free end of the bag and subsequently applying the clip perpendicularly along the rolled or folded thickness of the bag.

While the invention has been described with reference to preferred embodiments, those skilled in the art will appreciate that certain substitutions, alterations, and omissions may be made without departing from the spirit of the invention. Accordingly, the foregoing description is meant to be exemplary only and should not limit the scope of the invention set forth in the following claims.

I claim:

1. A closure clip for fastening closed a bag or similar article, comprising:

a unitary, generally flat, slotted body having three elongated, juxtaposed, spaced-apart members, the members defining slots extending longitudinally between the members wherein the slots are separate and spaced apart from each other, the members being further shaped so that the slots have a wide, bag-gathering area located at open ends of the slots which continually transition to narrow, bag-accepting areas at closed ends of the slots wherein the narrow, bag-accepting areas of each of the slots are of different widths to accommodate different bag thicknesses; and at least one aperture located in the body spaced-apart from the members and the slots and sized to accommodate a human's finger or thumb.

2. A closure clip according to claim 1 wherein the clip is constructed of metal.

3. A closure clip for fastening closed a bag or similar article, comprising:

a unitary, generally flat, slotted body having at least two elongated, juxtaposed, spaced-apart members, the members defining at least one slot extending longitudinally between the members, the members being further shaped so that the slot has a wide, bag-gathering area located at an open end of the slot which continually transitions to a narrow bag-accepting area at a closed end of the slot; and at least one aperture located in the body spaced-apart from the members and the slot and sized to accommodate a human's finger or thumb; and the closure clip is constructed of metal and the metal is magnetized to allow the closure clip to be stored on a flat, vertical metal surface.

4. A closure clip according to claim 1 wherein the clip is constructed of plastic.

5. A closure clip according to claim 4 wherein the plastic is high density polyethylene.

6. A closure clip according to claim 1 wherein the aperture in the body is circular in shape to better accommodate a human's finger or thumb.

7. A closure clip according to claim 1 wherein the at least one aperture is provided with a reinforcing ridge.

8. A closure clip according to claim 1 wherein a reinforcing ridge is located along a peripheral edge of the body.

9. The closure clip according to claim 1 wherein the aperture is spaced apart and generally located on an opposite end of the body from the wide, bag-gathering areas of the slots.

10. A closure clip according to claim 1 wherein the body includes a substantially flat area to accept printing, advertising, decorating and labeling.

11. A closure clip for fastening closed a bag or similar article, comprising:

a unitary, generally flat, slotted body having at least two elongated, juxtaposed, spaced-apart members, the members defining at least one slot extending longitudinally between the members, the members being further shaped so that the slot has a wide, bag-gathering area located at an open end of the slot which continually transitions to a narrow bag-accepting area at a closed end of the slot; and at least one aperture located in the body spaced-apart from the members and the slot and sized to accommodate a human's finger or thumb wherein a surface of the body facing the aperture is textured to provide improved grip to a human finger or thumb inserted through the aperture.

12. A closure clip according to claim 1 wherein the body of the closure clip includes at least one tool integrally molded along a peripheral edge of the body selected from the group consisting of a notch for opening bottles, a screwdriver head for turning screws, and a hook to open tabbed cans.

* * * * *